US006542614B2

(12) United States Patent
Renner

(10) Patent No.: US 6,542,614 B2
(45) Date of Patent: Apr. 1, 2003

(54) BOOMLESS HEARING/SPEAKING CONFIGURATION FOR SOUND RECEIVING MEANS

(75) Inventor: Heinz Renner, Kaltenleutgeben (AT)

(73) Assignee: Koninklijke Philips Electronics N.V., Eindhoven (NL)

( * ) Notice: Subject to any disclaimer, the term of this patent is extended or adjusted under 35 U.S.C. 154(b) by 0 days.

(21) Appl. No.: 10/101,091

(22) Filed: Mar. 13, 2002

(65) Prior Publication Data

US 2002/0136422 A1 Sep. 26, 2002

(30) Foreign Application Priority Data

Mar. 21, 2001 (EP) ..... 01890091

(51) Int. Cl.[7] ..... H04R 25/00

(52) U.S. Cl. ..... 381/370; 381/356; 381/357; 379/430

(58) Field of Search ..... 381/313, 356, 381/357, 358, 370, 375, 380; 379/430, 431, 431.01, 431.03; 455/100

(56) References Cited

U.S. PATENT DOCUMENTS 5,373,555 A * 12/1994 Norris et al. ..... 381/356

* cited by examiner

*Primary Examiner*—Huyen Le
(74) *Attorney, Agent, or Firm*—Edward W. Goodman

(57) ABSTRACT

A hearing/speaking configuration (1) having a housing (2), having sound-reproducing means (20) accommodated in the housing (2), and having sound-receiving means (19) designed without a boom, wherein the sound-receiving means (19) is accommodated in the housing (2), as is the sound-reproducing means (20), wherein a first sound passage opening (16) and a second sound passage opening (25) are provided in the housing (2) and the sound-receiving means (19) has a directional characteristic with a main direction (28) and an extinction direction (30), and wherein the extinction direction (30) extends from the sound-receiving means (19) to the sound-reproducing means (20).

2 Claims, 1 Drawing Sheet

BOOMLESS HEARING/SPEAKING CONFIGURATION FOR SOUND RECEIVING MEANS

Figure 1:
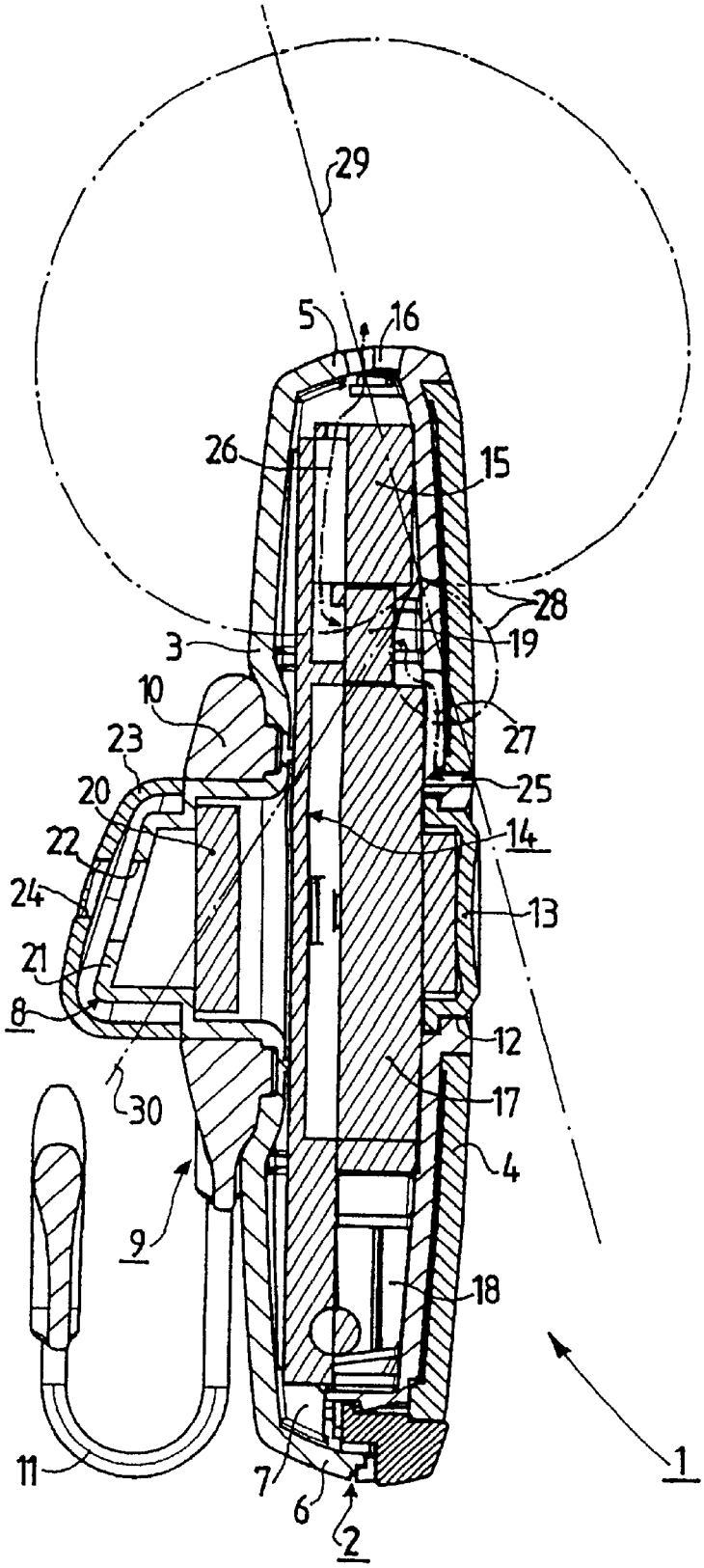

The invention relates to a hearing/speaking configuration which is designed for wearing on a person's head, which has a housing and a sound-reproducing means accommodated in the housing, and which has a sound-receiving means.

Such a hearing/speaking configuration has been marketed, for example, by Ericsson under the type designation HBH-10, and is therefore known. In the known hearing/speaking configuration, a so-termed boom is provided which has a microphone as a sound-receiving means in the region of its free end, as a result of which the microphone is located at a relatively large distance from the loudspeaker which is accommodated in the housing which is provided as a sound-reproducing means, and which constitutes a noise source for the microphone, and the microphone is located as close as possible to the mouth of a person when the known hearing/speaking configuration is seated on an ear of this person, something which is favorable for good sound reception. However, the presence of the boom leads to the problem in the known hearing/speaking configuration that the hearing/speaking configuration has a center of gravity situated relatively far away from the ear, so that in some situations of use—for example whenever the known hearing/speaking configuration is being used while a person is walking—the known hearing/speaking configuration may easily become displaced relative to the ear, and may even become detached from the person's ear as a result of the impact forces acting on the hearing/speaking configuration while the person is walking. Furthermore, the microphone in the known hearing/speaking configuration is located relatively close to the mouth or to the nose of a person, as a result of which there is a relatively high sensitivity to air currents which are caused by the mouth or the nose.

The invention has for its object to avoid the problems indicated above and to create an improved hearing/speaking configuration.

In order to achieve this object, inventive features are provided in a hearing/speaking configuration in accordance with the invention such that a hearing/speaking configuration in accordance with the invention can be defined as follows:

A hearing/speaking configuration which is designed for wearing on a person's head, which has a housing, which has sound-reproducing means accommodated in the housing, and which has sound-receiving means, wherein the hearing/speaking configuration is designed without a boom for the sound-receiving means, wherein the sound-receiving means is accommodated, as is the sound-reproducing means, in the housing, wherein the housing has at least one first sound passage opening and at least one second sound passage opening provided at a distance from the at least one first sound passage opening for the purpose of cooperating with the sound-receiving means, wherein the sound-receiving means has directional characteristic with a main direction and an extinction direction, and wherein the sound-receiving means and the at least one first sound passage opening and the at least one second sound passage opening assume relative positions with respect to one another such that the extinction direction of the directional characteristic of the sound-receiving means is directed substantially toward the sound-reproducing means.

The features in accordance with the invention achieve in a structurally simple and moderately priced way that the hearing/speaking configuration in accordance with the invention can be of a particularly compact design and that the design without a boom for the sound-receiving means renders it possible to realize a center of gravity which is situated as close as possible to that region in which the hearing/speaking configuration in accordance with the invention is connected to a person's head. This ensures, virtually in all situations of use of the hearing/speaking configuration, i.e. even during walking as described above, that the hearing/speaking configuration in accordance with the invention is always acceptably seated on a person's head and, in particular, on a person's ear. A further advantage is that the sound-receiving means is located relatively far removed from a person's mouth and nose such that a hearing/speaking configuration in accordance with the invention is relatively insensitive to air currents caused by a person's mouth or nose. In the hearing/speaking configuration in accordance with the invention, it is advantageously ensured that a sound output from the sound-reproducing means, which could constitute a disturbance for the sound-receiving means because of the compact structural design, cannot lead to any disturbing effect in the region of the sound-receiving means because the sound-receiving means with its directional characteristic is situated in the extinction direction in relation to the sound-reproducing means.

It may be mentioned at this juncture that the directional characteristic of the sound-receiving means can be formed by a cardioid characteristic or a supercardioid characteristic or a hypercardioid characteristic, or else by what is termed a figure eight (8) characteristic.

In a hearing/speaking configuration in accordance with the invention, it has proved to be particularly advantageous when the features in accordance with claim 2 are provided in addition. Such a design has proved to be particularly advantageous with regard to an effective cooperation with a person's ear, and with regard to as simple and compact a structural design as possible.

The above and further aspects of the invention will become apparent from the embodiment described below and are explained with reference to this embodiment.

The invention will be described below with reference to an embodiment illustrated in the drawing, but to which the invention is not limited.

FIG. 1 shows a cross-section of a hearing/speaking configuration in accordance with the invention.

FIG. 1 shows a hearing/speaking configuration 1 which will be denoted below as configuration 1. The configuration 1 is designed for wearing on a person's head. The configuration 1 has a housing 2 which has a substantially cuboid shape. The housing 2 has a first cuboid main wall 3 and a second cuboid main wall 4, as well as a first short side wall 5 and a second short side wall 6, and a first long side wall 7 and a second long side wall (not visible in FIG. 1). The housing 2 is provided with a tower-like housing portion 8 in the region of the first cuboid main wall 3. A fastening part 9 is provided on the tower-like housing portion 8. The fastening part 9 has an annular base portion 10 which is held such that it can be rotated with respect to the tower-like housing portion 8. Connected to the base portion 10 is a bow 11 by means of which the configuration 1 can be fastened to a person's ear. Provided in the region of the second cuboid main wall 4 is a passage 12 through which a key 13 projects, which key 13 is provided for switching the configuration 1 on and off.

In the interior of the housing 2 there is a substantially plate-shaped holding device 14 which is provided and designed for holding components of the configuration 1. A diagrammatically illustrated socket 15 is connected to the holding device 14, with which socket 15 a plug (not shown in FIG. 1) can be brought into engagement through a passage opening 16 in the first side wall 5, in order to be able to feed a supply voltage to the configuration 1. A rechargeable battery 17 is further connected to the holding device 14. Furthermore, an electric circuit 18, which is provided for cooperation with a microphone 19 and a loudspeaker 20, is connected to the holding device 14. Also connected to the holding device 14 is the microphone 19, which is provided as a sound-receiving means on the configuration 1.

The loudspeaker 20 is accommodated in the tower-like housing section 8, thus forming a sound-reproducing means accommodated in the housing 2 and giving off sound generated by it through a passage opening 22 provided in an end wall 21 of the housing section 8, the sound output via the passage 22 additionally also further passing through a passage 24 provided in a cover cap 23 before the output sound is output into the auricle of a person wearing the configuration 1.

As may be seen from FIG. 1, the configuration 1 is designed without a boom for the microphone 19. Specifically, the microphone 19 is accommodated, like the loudspeaker 20, in the housing 2 in the configuration 1.

For the purpose of cooperation with the microphone 19, the housing 2 has a first sound passage opening 16, which is formed by the passage opening 16 already mentioned above and serving for passing through the plug (not shown). Furthermore, the housing 2 has a second sound passage opening 25 provided at a distance from the first sound passage opening 16. The second sound passage opening 25 is provided in this case in the second cuboid main wall 4, which second cuboid main wall 4 is situated opposite the first cuboid main wall 3 provided with the tower-like housing section 8.

A sound path diagrammatically indicated by a dot-dash arrow 26 in FIG. 1 is provided in the configuration 1 between the first sound passage opening 16 and the microphone 19. Furthermore, a sound path indicated in FIG. 1 by a further dot-dash arrow 27 is provided between the microphone 19 and the second sound passage opening 25. It may be mentioned at this juncture that it is possible to provide not just a single first sound passage opening 16 and not just a single second sound passage opening 25, but that it is also possible to provide a plurality of first sound passage openings and a plurality of second sound passage openings.

In the configuration 1 of FIG. 1, the microphone 19 has a directional characteristic, specifically a supercardioid characteristic, for example as indicated diagrammatically in FIG. 1 by the dot-dash line 2 result of a suitable selection of the design of the microphone 19, and as a result of the presence of the first sound passage opening 16, and as a consequence of the presence of the second sound passage opening 35. The supercardioid characteristic 28 has a main direction 29 and an extinction direction 30, which is utilized in the present case. The supercardioid characteristic 28 also has a second extinction direction, which is not, however, used in the present case. It may be mentioned that it is alternatively possible to use a microphone having a directional characteristic with more than two extinction directions, of which at least one extinction direction is utilized.

In the configuration 1 of FIG. 1, the microphone 19 and the first sound passage opening 16 and the second sound passage opening 25 are provided such that the microphone 19 and the first sound passage opening 16 and the second sound passage opening 25 adopt relative positions with respect to one another such that the extinction direction 30 of the supercardioid characteristic 28 of the microphone 19 is substantially directed toward the loudspeaker 20, as may be seen from FIG. 1. The microphone 19 is arranged in this case in a region situated between the tower-like housing portion 8 and the first side wall 5 of the housing 2, the first sound passage opening 16 is provided in the first side wall 5, and the second sound passage opening 25 is provided in the second cuboid main wall 4.

A particularly compact structural design is achieved in the configuration 1 on the basis of the arrangement described above. Since all components are accommodated inside the housing 2 in the configuration 1, it is further achieved in a simple way that the components of the configuration 1 accommodated in the housing are arranged and fixed such that the center of gravity of the configuration 1 is situated substantially next to the tower-like housing portion 8 by which the configuration 1 is connected to a person's ear, so that virtually no unfavorable lever ratios are present which could have an unfavorable effect on a person's ear in the case of impact loads on the configuration 1, thus always ensuring that the configuration 1 is effectively and permanently connected to the person's ear or head.

What is claimed is:

1. A hearing/speaking configuration for being worn on a person's head, said hearing/speaking configuration having a housing, sound-reproducing means accommodated in the housing, and sound-receiving means, the hearing/speaking configuration being designed without a boom for the sound-receiving means, wherein the sound-receiving means is accommodated, along with the sound-reproducing means, in the housing, the housing having at least one first sound passage opening, and at least one second sound passage opening provided at a distance from the at least one first sound passage opening, said at least one first and second sound passage openings cooperating with the sound-receiving means, the sound-receiving means having directional characteristics with a main direction and an extinction direction, wherein the sound-receiving means, the at least one first sound passage opening, the at least one second sound passage opening, and the sound-reproducing means occupy relative positions with respect to one another such that the extinction direction of the directional characteristics of the sound-receiving means is directed substantially toward the sound-reproducing means.

2. The hearing/speaking configuration as claimed in claim 1, wherein the housing has an essentially cuboid shape, said housing having a tower-shaped housing portion in the region of a first cuboid main wall for accommodating the sound-reproducing means, the sound-receiving means being arranged in a region situated between the tower-shaped housing portion and a first side wall of the housing, the at least one first sound passage opening being provided in the first side wall of the housing, and the at least one second sound passage opening being provided in a second cuboid main wall situated opposite the first cuboid main wall provided with the tower-shaped housing portion.

* * * * *